US010760219B2

(12) United States Patent
Niemi

(10) Patent No.: US 10,760,219 B2
(45) Date of Patent: Sep. 1, 2020

(54) LIGHT PACKAGING PAPER FOR FOOD HAVING IMPROVED RESISTANCE TO FATS

(71) Applicant: DELFORTGROUP AG, Traun (AT)

(72) Inventor: Petri Niemi, Lohja (FI)

(73) Assignee: delfortgroup AG, Traun (AT)

( * ) Notice: Subject to any disclaimer, the term of this patent is extended or adjusted under 35 U.S.C. 154(b) by 194 days.

(21) Appl. No.: 16/093,201

(22) PCT Filed: Apr. 13, 2017

(86) PCT No.: PCT/EP2017/058970
§ 371 (c)(1),
(2) Date: Oct. 12, 2018

(87) PCT Pub. No.: WO2017/178604
PCT Pub. Date: Oct. 19, 2017

(65) Prior Publication Data

US 2019/0203423 A1 Jul. 4, 2019

(30) Foreign Application Priority Data

Apr. 13, 2016 (DE) ..... 10 2016 106 852

(51) Int. Cl.
*D21H 27/10* (2006.01)
*D21H 17/17* (2006.01)
(Continued)

(52) U.S. Cl.
CPC ..... *D21H 27/10* (2013.01); *D21H 17/17* (2013.01); *D21H 17/28* (2013.01); *D21H 19/36* (2013.01);
(Continued)

(58) Field of Classification Search
CPC ..... D21H 27/10; D21H 17/17; D21H 17/28; D21H 19/54; D21H 21/16; D21H 21/52; D21H 19/36; D21H 21/14
See application file for complete search history.

(56) References Cited

U.S. PATENT DOCUMENTS 6,677,386 B1 1/2004 Giezen et al.

FOREIGN PATENT DOCUMENTS

CA 2 467 601 A1 11/2004
DE 10237913 2/2004
(Continued)

OTHER PUBLICATIONS

International Searching Authority—EPO International Search Report and Written Opinion, PCT/EP2017/058970; dated Jul. 11, 2017. 13 pages.
(Continued)

*Primary Examiner* — Michael C Miggins
(74) *Attorney, Agent, or Firm* — Sunstein LLP

(57) ABSTRACT

Packaging paper for food, with a basis weight from 20 g/m$^2$ to 50 g/m$^2$, comprising cellulose fibers and one or more filler materials, wherein the total amount of filler materials is between 5% by weight and 20% by weight with respect to the weight of the packaging paper, wherein the packaging paper comprises a sizing agent that is contained in such an amount that a relative water absorption of 0.4 to 0.7 is obtained on both sides, wherein the relative water absorption is defined as the quotient of the $Cobb_{60}$ value, determined in accordance with ISO 535:2014, and the basis weight, has a coating on at least one side that comprises nanoparticles of a starch, wherein the coating contains between 1 g/m$^2$ and 6 g/m$^2$ of said nanoparticles, (Continued)

| Paper | Basis Weight | Long Fiber | Short Fiber | Fillers | Nano-particles | Coating |
|---|---|---|---|---|---|---|
| | g/m2 | % by weight | % by weight | Amount in %, Type | g/m2 | |
| A | 35.2 | 60 | 40 | 10% $CaCO_3$ | 0 | None |
| B | 25.4 | 60 | 40 | 10% $CaCO_3$ | 1.7 | FS |
| C | 30.7 | 60 | 40 | 10% $CaCO_3$ | 2.8 | FS |
| D | 38.8 | 60 | 40 | 10% $CaCO_3$ | 3.1 | FS |
| E | 45.9 | 60 | 40 | 10% $CaCO_3$ | 5.1 | FS |
| F | 46.3 | 60 | 40 | 5% $CaCO_3$ 5% $TiO_2$ | 5.5 | FS+WS |
| G | 38.5 | 60 | 40 | 10% $CaCO_3$ | 3.3 | FS |
| H | 35.6 | 40 | 60 | 15% $CaCO_3$ | 4.7 | FS |
| J | 40.3 | 70 | 30 | 5% $CaCO_3$ | 3.7 | WS |
| K | 39.8 | 60 | 40 | 10% $CaCO_3$ | 4.2 | FS |
| L | 40.5 | 60 | 40 | 10% $CaCO_3$ | 4.3 | FS |

Table 1 does not contain any compounds with the structure $CF_3(CF_2)_n(CH_2)_mX$, wherein n=5 or n=7 and m=0, 1 or 2 and X is a hydroxyl group (X═OH) or a carboxyl group (X═COOH), or the proportion of such compounds in the total mass of the packaging paper is less than 0.1‰, and has a resistance against greases and oils of 6 to 12, described by the KIT level in accordance with TAPPI T559 cm-12, wherein in the test in accordance with TAPPI T559 cm-12, the at least one side coated with said nanoparticles is exposed to the test liquids.

27 Claims, 2 Drawing Sheets

(51) Int. Cl.

| | |
|---|---|
| ***D21H 17/28*** | (2006.01) |
| ***D21H 19/54*** | (2006.01) |
| ***D21H 21/16*** | (2006.01) |
| ***D21H 21/52*** | (2006.01) |
| ***D21H 19/36*** | (2006.01) |
| ***D21H 21/14*** | (2006.01) |

(52) U.S. Cl.

CPC ..... *D21H 19/54* (2013.01); *D21H 21/14* (2013.01); *D21H 21/16* (2013.01); *D21H 21/52* (2013.01)

(56) References Cited

FOREIGN PATENT DOCUMENTS

| | | |
|---|---|---|
| WO | WO 2013/013786 A1 | 1/2013 |
| WO | WO 2013160199 | 10/2013 |
| WO | WO 2015/144983 A1 | 10/2015 |
| WO | WO 2015180699 | 12/2015 |

OTHER PUBLICATIONS

International Searching Authority—EPO English Translation of International Preliminary Report on Patentability, PCT/EP2017/058970; dated Oct. 16, 2018. 6 pages.

| Paper | Basis Weight | Long Fiber | Short Fiber | Fillers | Nano-particles | Coating |
|---|---|---|---|---|---|---|
| | g/m² | % by weight | % by weight | Amount in %, Type | g/m² | |
| A | 35.2 | 60 | 40 | 10% $CaCO_3$ | 0 | None |
| B | 25.4 | 60 | 40 | 10% $CaCO_3$ | 1.7 | FS |
| C | 30.7 | 60 | 40 | 10% $CaCO_3$ | 2.8 | FS |
| D | 38.8 | 60 | 40 | 10% $CaCO_3$ | 3.1 | FS |
| E | 45.9 | 60 | 40 | 10% $CaCO_3$ | 5.1 | FS |
| F | 46.3 | 60 | 40 | 5% $CaCO_3$ 5% $TiO_2$ | 5.5 | FS+WS |
| G | 38.5 | 60 | 40 | 10% $CaCO_3$ | 3.3 | FS |
| H | 35.6 | 40 | 60 | 15% $CaCO_3$ | 4.7 | FS |
| J | 40.3 | 70 | 30 | 5% $CaCO_3$ | 3.7 | WS |
| K | 39.8 | 60 | 40 | 10% $CaCO_3$ | 4.2 | FS |
| L | 40.5 | 60 | 40 | 10% $CaCO_3$ | 4.3 | FS |

Table 1

Fig. 1

| Paper | $Cobb_{60}$ | | Relative Water Absorption | | Air Permeability (Gurley) | KIT Level | |
|---|---|---|---|---|---|---|---|
| | FS | WS | FS | WS | s | FS | WS |
| | $g/m^2$ | $g/m^2$ | | | | | |
| A | | | | | | 0-2 | 0-2 |
| B | 16 | 16 | 0.63 | 0.63 | 2428 | 6-7 | |
| C | 16 | 17 | 0.52 | 0.55 | 2307 | 7-8 | |
| D | 17 | 19 | 0.44 | 0.49 | 6685 | 6-7 | |
| E | 22 | 25 | 0.48 | 0.54 | 5893 | 7-8 | |
| F | 19 | 20 | 0.41 | 0.43 | 7251 | 9-10 | 10-11 |
| G | 17 | 18 | 0.43 | 0.47 | 8320 | 7-8 | |
| H | 22 | 24 | 0.62 | 0.67 | 1224 | 5-6 | |
| J | 19 | 19 | 0.47 | 0.47 | 3866 | | 6-7 |
| K | 33 | 36 | 0.82 | 0.90 | 3531 | 3-4 | |
| L | 10 | 8 | 0.25 | 0.20 | 3697 | 4-5 | |

Table 2

Fig. 2

LIGHT PACKAGING PAPER FOR FOOD HAVING IMPROVED RESISTANCE TO FATS

CROSS-REFERENCE TO RELATED APPLICATIONS

This Application is a U.S. national stage entry under 35 USC § 371 of Patent Cooperation Treaty Application PCT/EP2017/058970, filed Apr. 13, 2017, which claims priority from German Patent Application 10 2016 106 852.7, filed Apr. 13, 2016, both of which are incorporated herein by reference in their entireties.

FIELD OF THE INVENTION

The invention relates to a paper for packaging food. In particular, it relates to a paper which, despite its low basis weight, has a sufficient resistance against penetration by greases and oils due to a combination of special paper properties with a coating of nanoparticles of a biopolymer and which is nevertheless well suited for recycling and is toxicologically harmless.

BACKGROUND AND PRIOR ART

A packaging paper for food has to fulfill many different and occasionally contradicting requirements. A first function of the packaging paper is that it protects the packaged food from environmental influences. This requires at least a certain mechanical strength and a chemical stability against typical environmental influences. A second function consists in that the packaging paper should also protect the environment from influences by the packaged food, with which it potentially comes into contact. For food this requires above all a sufficient resistance against the penetration of greases, oils and water through the packaging paper. Additionally the packaging paper for food should have a defined resistance against the penetration of water vapor, in order to prevent the food from drying out too quickly.

Because packaging paper for food is very often used only once, for ecological reasons it makes sense for the packaging paper to be recycled as easily as possible or, if it is not disposed of properly, that it can degrade biologically.

For the same reason, it is also desirable for the packaging paper for food to have a basis weight that is as low as possible, so that only a little raw material has to be used for the production and the amount of waste which is generated by the disposal of the packaging paper is comparatively small.

Typically, the requirements of a high or defined resistance against the penetration of greases and oils and good recyclability or biodegradability in combination with a low basis weight of the packaging paper contradict each other.

A process known in the state of the art for the production of packaging papers that achieves very good resistance against the penetration of greases, oils and water or water vapor consists in coating a base paper on one side with polyethylene, for example in an extrusion process. Because of this coating, such a paper cannot be recycled, or only with substantial effort. This process thus does not sufficiently fulfil the requirements of recyclability or biodegradability.

Another process known in the state of the art for the production of packaging papers that produces a very good resistance against the penetration of greases, oils and water consists in coating the paper with certain fluorine-containing substances. In particular, polyfluorinated organic compounds and above all fluorotelomer alcohols, $CF_3(CF_2)_n(CH_2)_mOH$ with n=1, 2, . . . , in particular with n=5 or n=7 and m=0, 1, 2, . . . , 10, in particular with m=0, 1 or 2, have been suitable for this application. The use of these substances, however, can lead to contamination with perfluorooctanoic acid (PFOA, $C_8HF_{15}O_2$), which accumulates in the human organism and is rated as reproductively toxic, carcinogenic and toxic by the EU's REACH Regulations (Registration, Evaluation, Authorization of Chemicals). For this reason alone, polyfluorinated organic compounds are not desired as a component of a packaging paper and in particular not as a component of a packaging paper for food. Additionally, such papers are barely recyclable.

Many attempts to coat a packaging paper for food with substances of primarily biological origin so that, apart from good recyclability or biodegradability, a high resistance against the penetration of greases, oils and water can also be obtained, were not successful, because that resistance could not even come close to the high resistance against the penetration of greases, oils and water which is offered by a coating with polyethylene or polyfluorinated organic compounds, in particular not for packaging papers with a low basis weight.

In other experiments with a coating of the packaging paper with petroleum-based waxes, a high resistance against the penetration of greases, oils and water could be obtained, but the requirement for good recyclability or biodegradability was again only partially satisfied. In addition, these waxes based on petroleum products are ecologically disadvantageous.

A paper is described in WO 2015/180699 that contains nanoparticles of a biopolymer. These nanoparticles primarily increase the dry strength of the paper, so that a higher proportion of recycled fibers can be used, which provides ecological advantages. Furthermore, these nanoparticles increase the resistance against greases and oils. However, the papers described in this patent application are comparatively heavy, above 60 g/m$^2$, and considerable amounts of nanoparticles are required, typically at least 6 g/m$^2$, to obtain a sufficient strength. In addition, the use of perfluorooctanoic acid is still described as advantageous and despite all these measures, no resistance against greases or oils is obtained which exceeds a KIT level of 5.

Therefore, there is still a great need in the industry for a packaging paper to be available that has good strength and low raw material consumption, does not use organic fluorine compounds and nevertheless has a high resistance against greases and oils.

SUMMARY OF THE INVENTION

The objective of the present invention is to provide a packaging paper for food, which has a low basis weight, offers a sufficiently high resistance against the penetration of greases and oils and can be easily recycled or biodegraded.

This objective is achieved by means of a packaging paper according to claim 1 and by a manufacturing process according to claim 22. Advantageous further embodiments are provided in the dependent claims.

The packaging paper according to the invention has a basis weight of 20 g/m$^2$ to 50 g/m$^2$, comprises pulp fibers and one or more filler materials, wherein the total amount of filler materials is between 5% by weight and 20% by weight with respect to the weight of the packaging paper. Furthermore, the packaging paper comprises a sizing agent, which is contained in an amount such that a relative water absorption of 0.4 to 0.7 results for both sides, which is expressed by the quotient of the $Cobb_{60}$ value determined in accordance with ISO 535:2014 and the basis weight.

Furthermore, the packaging paper according to the invention has a coating on at least one side that comprises nanoparticles of a starch, wherein the packaging paper contains between 1 g/m$^2$ and 6 g/m$^2$ of said nanoparticles, and the packaging paper does not contain any compounds with the structure $CF_3(CF_2)_n(CH_2)_mX$, wherein n=5 or n=7 and m=0, 1 or 2 and X is a hydroxyl group (X=OH) or a carboxy group (X=COOH), or in any case contains a proportion of the total mass of the packaging paper of such substances which does not exceed 0.1‰, and it has a resistance against greases and oils of 6 to 12, described by the KIT level in accordance with TAPPI T559 cm-12, when in this test the at least one side coated with said nanoparticles is exposed to the test liquids. In preferred embodiments, this resistance against greases and oils is, however, produced on both sides.

In the prior art, it is assumed that the water absorption of a packaging paper should be low in order to achieve a sufficient barrier effect. The packaging paper should thus be water-repellent. This ensures that on the one hand, water cannot pass quickly through the packaging paper, and on the other hand that water-based coating solutions remain on the surface of the packaging paper.

However, the inventors have surprisingly found that the water absorption should not be as low as possible, but that for the overall function of the paper in combination with said nanoparticles, it is of considerable advantage for it to be within a certain, narrow range of values. The inventors have found that in this narrow range of values, a water-based coating material can be optimally distributed between the surface and the bulk of the packaging paper and a high barrier effect can be obtained despite the low basis weight, so that less coating material is needed.

Furthermore, the inventors have found that the absolute water absorption, as it can, for example, be measured in accordance with ISO 535:2014 and expressed as the $Cobb_{60}$ value in g/m$^2$, is not what is relevant, but rather that it is more important for the water absorption with respect to the basis weight of the packaging paper to be selected suitably. To this end the relative water absorption is defined as a dimensionless ratio of the $Cobb_{60}$ value in accordance with ISO 535:2014 and the basis weight in accordance with ISO 536:2012. As an example, if the $Cobb_{60}$ value is 15 g/m$^2$ and the basis weight is 35 g/m$^2$, then the relative water absorption is 15/35≈0.428. The invention relates to nanoparticles of a starch suspended in water and the experiments show that, essentially independently of the basis weight, an optimal distribution of nanoparticles of a starch in the packaging paper can be obtained for a relative water absorption between 0.4 and 0.7, preferably between 0.4 and 0.6, so that the finished packaging paper, if it contains the nanoparticles of a starch in an amount of only 1 g/m$^2$ to 6 g/m$^2$, already produces a KIT level in accordance with TAPPI T559 cm-12 of at least 6. This is a first important advantage of the invention. Additionally, the use of the undesired organic fluorine compounds, which are commonly used as a barrier against greases and oils can be completely avoided; this constitutes a further advantage of the invention, particularly with respect to ecological aspects.

It is also an essential aspect of the invention that the relative water absorption of both sides of the paper is in the aforementioned range from 0.4 to 0.7 and preferably from 0.4 to 0.6. This contradicts the expectations in the state of the art, because the absolute and relative water absorption of the coated side of the paper is generally lower than that of the uncoated side, while for the invention, it is important for the relative water absorption to be in the indicated range independently of any coating.

The packaging paper according to the invention has a basis weight between 20 g/m$^2$ and 50 g/m$^2$. Generally, in order to save raw materials, the basis weight will be selected to be as low as possible, however this reduces the barrier effect against greases and oils, so that a preferred range for the basis weight is between 25 g/m$^2$ and 40 g/m$^2$. The basis weight of a paper can be measured in accordance with ISO 536:2012.

The packaging paper according to the invention comprises pulp fibers. Basically, any of the pulp fibers known in the prior art with which the generally presupposed technical properties such as, for example, sufficient tensile strength, can be obtained can be considered. In the context of the invention, it has been shown to be advantageous for the pulp fibers to be sulfate pulp fibers and comprise 25% by weight to 75% by weight long fibers and 25% by weight to 75% by weight short fibers, wherein the percentages refer to the mass of the pulp fibers. Long-fiber sulfate pulp can be sourced from spruce or pine, for example, while the short-fiber pulp can be sourced from birch, beech or *eucalyptus*, for example. The use of pulp fibers from other plants such as flax, hemp, sisal, aback ramie, jute, kenaf or esparto grass is also possible and may be suitable in order to obtain a particularly high tensile strength (flax, hemp, sisal, abacá) or a high paper volume (esparto grass).

In addition, fibers from regenerated cellulose such as modal fibers or lyocell fibers can be used, but they deteriorate the biodegradability. Fibers from thermoplastic materials such as polyethylene or polypropylene can also be used, in particular if a hot sealing capability is required. Naturally, these fibers also deteriorate the biodegradability.

Generally, the pulp fibers will be bleached, because then the packaging paper is white and is often also printed. Alternatively, the pulp fibers or at least a part thereof can be unbleached. The packaging paper will then have a light brown to dark brown color. The use of unbleached pulp fibers can be of advantage, if ecological aspects of the packaging paper are of particular importance.

Less preferred are recycled fibers, which are mainly sourced from waste paper, because such fibers are often contaminated by substances that are not desired in packaging for food. This includes, for example, mineral oil-based saturated hydrocarbons (MOSH) or mineral oil-based aromatic hydrocarbons (MOAH). In a preferred embodiment, the packaging paper contains no or almost no recycled fibers, in particular not those from waste paper. In a particularly preferred embodiment, the aforementioned pulp fibers are not recycled, that is, they are completely or at least 95% by weight fresh fibers ("virgin pulp").

The packaging paper according to the invention comprises filler materials. The proportion of filler materials in the packaging paper is, however, rather low and is between 5% by weight and 20% by weight with respect to the mass of the finished packaging paper. When manufacturing paper in general, and in particular packaging paper, the skilled person strives to select the filler content to be as high as possible, because in this manner, a higher whiteness, higher opacity and lower costs of the packaging paper can be obtained. Currently, the trend in paper production is towards higher filler content, which can well be at 40% by weight or higher. The inventors have found that for the purposes of this invention, a comparatively lower filler content is of decisive importance. The reason is that a high filler content provides the paper with a porous structure which deteriorates the barrier effect. For this reason, in all cases the filler content is between 5% by weight and 20% by weight, but preferably between 5% by weight and 15% by weight.

Various filler materials can be used as filler materials. This includes, for example, mainly carbonates, such as precipitated or geologically sourced calcium carbonate or magnesium carbonate; metal oxides, such as titanium dioxide or magnesium oxide; metal hydroxides, such as magnesium hydroxide or aluminum hydroxide; and silicates such as kaolin or talcum. The use of mixtures of these filler materials is compatible with the invention.

As an example, titanium dioxide can be used as the sole filler material or as a mixture in order to increase the opacity and whiteness. Because titanium dioxide is particularly effective in this respect, the total filler content and thus the basis weight can be reduced for the same opacity and whiteness, and a low-porous structure is generated which is advantageous for the purposes of the invention.

Because of the high price of titanium dioxide, it is also possible to replace a part of the titanium dioxide by other filler materials, so called extenders, which, in combination with titanium dioxide, enhance its effect. However, for each unit mass of titanium dioxide which is to be replaced by an extender, several unit masses of the extender have to be used. Calcined kaolin, aluminum hydroxide ($Al(OH)_3$) or precipitated amorphous silicates can be considered as examples of extenders.

As an example, kaolin or talcum can also be used as the sole filler material or as a mixture in order to increase the smoothness of the packaging paper and to influence the porous structure. In this manner, the printability can be improved and a limited barrier effect can be obtained.

For the barrier effect of the packaging paper according to the invention, it is essential that the nanoparticles of a starch are applied to the packaging paper such that the finished packaging paper contains between 1 $g/m^2$ and 6 $g/m^2$ of the nanoparticles. This amount is sufficient to obtain a good resistance against greases and oils, what is known as a KIT level of 6 to 12, measured in accordance with TAPPI T559 cm-12. Preferably, the amount of nanoparticles of a starch in the packaging paper is between 1.5 $g/m^2$ and 5.5 $g/m^2$, and highly particularly preferably between 1.5 $g/m^2$ and 5 $g/m^2$.

By way of example, the production of nanoparticles of a starch suitable for the invention are described in WO 2008/022127, WO 2010/065750 and WO 2011/084692. In said patents, the nanoparticles are primarily used to improve the printability. The starches suitable for the production of the nanoparticles include, for example, potato starch, corn starch, wheat starch, rice starch or tapioca starch. Generally, starch with a high content of amylopectin, in particular those with a content of at least 90%, preferably at least 95% of amylopectin, are suitable.

The mean size of the nanoparticles is between 1 nm and 500 nm, preferably between 10 nm and 400 nm and particularly preferably between 40 nm and 200 nm.

In addition to the essential components for the packaging paper according to the invention, the packaging paper can contain further components.

These include sizing agents such as, for example, alkyl ketene dimers (AKD), alkenyl succinic anhydride (ASA) or resin sizes. These sizing agents make the paper hydrophobic and are necessary in order to adjust the relative water absorption of the packaging paper to the value required according to the invention. The skilled person will be able to determine the amount of sizing agent required in this regard by experience or by experiments. The sizing agent can be added in the bulk during production of the packaging paper or applied to the surface. For in-the-bulk addition, the sizing agent will already be contained in the suspension at the head box. This type of sizing will be called "sized in bulk" in the present disclosure and is preferred. Additionally or alternatively, the sizing agent can be applied to the surface, for example in the size press of a paper machine.

If the packaging paper has to be particularly water-resistant, it can contain a wet strength agent, which substantially increases the strength of the packaging paper in a wet state. A well suited wet strength agent is polyamine-polyamide-epichlorhydrin (PAE). As a point of reference, PAE can be used in an amount of 2 kg per ton of packaging paper.

A further optional component of the packaging paper is starch, wherein the nanoparticles of a starch are explicitly not included. Starch can be added to the packaging paper to increase its dry strength. Here again, the skilled person will be able to select the required amount according to experience and can be an amount of 5 kg per ton packaging paper as a point of reference.

In the case that only one side of the packaging paper is coated with the nanoparticles of a starch, the other side can be coated with ordinary starch to prevent the packaging paper from curling upon a change in humidity, because both sides of the packaging paper expand differently when moistened. For further processing of the packaging paper, in particular printing, it is important that the packaging paper does not curl.

In addition to filler materials, the packaging paper according to the invention can also contain pigments or colorants. As an example, yellow, red, brown or black iron oxides or carbon particles can be used to provide the paper with a color other than white. The term "pigments" should also be understood to encompass metal particles or plastic particles which provide a particular color or a particular gloss to the paper. In particular, for high-quality packaging paper, the use of gold foil can be considered.

Preferred colorants that can be used are those which can be processed in an aqueous composition, but which are not substantially dissolved from the packaging paper during contact with food, so that the food is not contaminated. In addition, the UV-resistance can play a role when selecting the colorant.

The packaging paper according to the invention can also be printed. In many cases, packaging papers for food are printed with trademarks, logos, company names, lists of ingredients or other information. Therefore, any conventional printing processes known in the prior art for packaging papers for food can be used, in particular rotogravure printing, flexographic printing or digital printing.

The packaging paper can be printed on none, one or both sides. If printed only on one side, preferably one side of the packaging paper is coated with the nanoparticles of a starch and the other side is printed. The side coated with nanoparticles of a starch is then preferably facing the food.

Further components of the packaging paper, such as those that are necessary for the production of the paper, can be appropriately selected by the skilled person. This includes, for example, retention aids, cross-linking aids, dispersing agents, de-foaming agents or biocides. In general, when using these components as well as all of the aforementioned components of the packaging paper, legal regulations must be taken into consideration.

Fluorine compounds are very frequently used in state of the art packaging papers for food, in particular those which have a high resistance against greases and oils. This includes a class of compounds with the general molecular formula $CF_3(CF_2)_n(CH_2)_mX$, what are known as fluorotelomer alcohols, if X is a hydroxyl group (X=OH), or fluorinated or perfluorinated carboxylic acids if X is a carboxyl group (X=COOH). In this regard, n can have the values n=1, 2, . . . and m the values m=0, 1, 2, . . . , 10.

Fluorotelomer alcohols with n=5 or n=7 and m=0, 1 or 2 and X=OH, as well as perfluorooctanoic acid with n=6, m=0 and X=COOH are of particular importance.

It is an essential objective and an important advantage of the packaging paper according to the invention that such fluorine compounds are not contained in the packaging paper. In this regard, the term "not contained" means that they are not contained in an amount that contributes to any great extent to the barrier effect against greases and oils. It is, however, possible and compatible with the invention, for it to contain traces of such fluorine compounds, which are caused by contamination, for example by contact with other packaging papers not according to the invention. In any case, the proportion of such fluorine compounds in the total mass of the packaging paper should not exceed 0.1‰.

A further property of the packaging paper essential for the invention is its water absorption. The absolute water absorption is determined in accordance with ISO 535:2014 and is given as the $Cobb_{60}$ value ("$Cobb_{60}$") in $g/m^2$. After determination of the basis weight of the packaging paper ("FLG") in $g/m^2$ in accordance with ISO 536:2012, the relative water absorption can be calculated by the ratio $Cobb_{60}$/FLG. Because the $Cobb_{60}$ value can be determined separately for the two sides of the packaging paper, a relative water absorption can also be assigned to each side of the packaging paper. It has been found to be essential for the purposes of the invention for the relative water absorption of both sides to be similar and to be between 0.4 and 0.7, preferably between 0.4 and 0.6. The inventors assume that an optimal distribution of the aqueous coating composition and thus of the nanoparticles in the packaging paper can only be obtained in this range of values. This optimal distribution guarantees the high resistance against greases and oils for comparatively low applied amounts and low basis weight of the packaging paper.

A further essential property of the packaging paper according to the invention is its resistance against the penetration of greases and oils. This property is quantified by the method described in TAPPI T559 cm-12. In this regard, 12 different test liquids are applied to the paper, which are sorted and numbered in ascending order from 1 to 12 by their tendency to penetrate paper. The liquids are tested in ascending order and the number of the last liquid which did not cause a penetration of the paper defines the resistance against greases and oils, which is then called the KIT level. The KIT level can assume values from 0 to 12. To achieve a sufficient resistance against greases and oils for packaging papers for usual foodstuffs, the KIT level should be at least 6 and at most 12; a KIT level from 6 to 10 is preferred, which is sufficient for the majority of all applications; a KIT level of 6 to 8 is more particularly preferred.

In the test in accordance with TAPP T559 cm-12, the side of the packaging paper coated with nanoparticles of a starch should face the test liquids. If both sides of the packaging paper are coated with nanoparticles of a starch, the KIT level has to be in a range from 6 to 12 for each of the two sides of the packaging paper. The KIT levels of both sides, however, can be different and the KIT level in the preferred narrower intervals can occur in any arbitrary combination and even on only one side of the packaging paper, while the KIT level for the other side can be outside the preferred interval, but must be in any case between 6 and 12.

The KIT level can be influenced primarily by the amount of nanoparticles of a starch in the packaging paper, wherein a higher applied amount also leads to a higher KIT level. Further measures which the skilled person can take to adjust the KIT level in the context of this invention are the selection of the type and amount of sizing agent, the refining of the pulp fibers and measures to increase the paper density, such as calendaring. For all these measures, however, the requirements regarding the relative water absorption have to be observed.

A further aspect of the invention, which is optional, but can generate further advantages with respect to the use of raw materials and the barrier effect against greases and oils, is the selection of a specific, low air permeability. The absorption of the coating composition into the paper structure is also determined by the porous structure of the packaging paper. A method to evaluate the porous structure of the packaging paper is the air permeability according to Gurley, which can be measured in accordance with ISO 5636-5:2013. In this regard, a pressure difference between the two sides of the packaging paper is applied and the time taken for a defined volume of air, typically 100 $cm^3$, to flow through a defined area of the paper is measured. The air permeability according to Gurley is given in seconds. A high value according to Gurley in seconds means a low air permeability, and vice versa, a low value in seconds means a high air permeability. The air permeability can in particular be influenced by refining the pulp during paper production and by selection of the type, amount and mean particle size of the filler material or the filler material mixture, and it is thus a parameter which the skilled person can adjust within a certain range.

In the context of the invention, the air permeability according to Gurley can be used to better adjust the barrier effect caused by nanoparticles of a starch and the paper structure. Preferably, the air permeability according to Gurley is between 1000 s and 10000 s, particularly preferably between 2000 s and 8000 s. This is a considerably lower air permeability than with packaging papers for food known in the prior art, which usually have an air permeability according to Gurley of 50 s to 500 s. In general, the air permeability according to Gurley is not dependent to a great extent on the direction of the gas flow through the paper, so that the given limits apply independently of the flow direction. In fact, the inventors' experiments have shown that for the purposes of increasing the resistance against oils and greases, the air permeability according to Gurley is of autonomous significance, in the sense that for two papers which are identical in all other essential parameters considered here, that which has a lower air permeability according to Gurley offers a better resistance against greases and oils. With preferred packaging papers care should be taken that the air permeability according to Gurley is at least 1000 s, preferably at least 2000 s.

The thickness of the packaging paper is between 20 μm and 60 μm, preferably between 25 μm and 50 μm. The thickness can be measured on a single layer in accordance with ISO 534:2011.

The tensile strength of the packaging paper is generally of importance for manufacture and use as packaging paper. The tensile strength usually differs in the machine direction and in the cross direction of the paper. In the machine direction, the tensile strength should be between 1 kN/m and 5 kN/m, preferably between 2 kN/m and 4 kN/m. In the cross direction, the tensile strength is generally lower, which is not a problem, as the load during many processes is primarily in the machine direction. The tensile strength in the cross direction should be between 0.5 kN/m and 4 kN/m, preferably between 1 kN/m and 3 kN/m.

In addition, the elongation at break of the packaging paper is of importance. A sufficient elongation at break is required in order to compensate for differences in speed as the packaging paper runs in the processing machines. In addition, the elongation at break is different in the machine direction and cross direction and should be between 1% and 3% in the machine direction and between 2% and 6% in the cross direction.

The tensile strength and elongation at break can be determined in accordance with ISO 1924-2:2008.

The production of the packaging paper according to the invention can be carried out entirely with equipment known in the prior art, for example by use of a Fourdrinier paper machine.

The application of the coating composition can then be carried out with application equipment known in the prior art. This may, for example, be the film press or size press in a paper machine, or also a separate application device for coating, such as a blade coater or a rod coater. The application of the coating composition can also be carried out by printing of the packaging paper.

The application of the coating composition to the packaging paper is carried out on at least one side, preferably to the felt side of the packaging paper. However, for a particularly high resistance against greases and oils, it is possible to coat both sides of the packaging paper. If both sides of the packaging paper are coated, the applied type and amount of nanoparticles of a starch can differ between the two sides, but in total the applied amount of nanoparticles of a starch for the packaging paper according to the invention must be between 1 g/m$^2$ and 6 g/m$^2$, as mentioned above.

The application of the coating composition to the packaging paper should preferably be to the entire surface of one side of the packaging paper, because areas excluded from the application will not have a sufficient resistance against greases and oils. However, areas that are definitely not coming into contact with the packaged food, because, for example, they are to be glued to other components of the packaging, can be excluded from application. In a particular embodiment of the invention, the coating composition can be applied to the packaging paper on one side in a pattern and to the other side in an approximately complementary pattern, so that each point of the packaging paper is coated with the nanoparticles of a starch on at least one side of the packaging paper. The term "approximately" in this regard can mean that the two patterns overlap slightly, so that an area of the packaging paper is never left without a coating on either side because of production tolerances.

The application of the coating composition can also be carried out such that the amount of nanoparticles of a starch varies over the surface of the packaging paper. As an example, in areas of the packaging paper which are known to have little contact with the food, less or no coating composition can be applied. These areas can have any arbitrary shape that is compatible with the application process. In this manner, for example, the consumption of nanoparticles of a starch can be reduced.

The coating composition preferably comprises at least water and nanoparticles of a starch. The proportion of nanoparticles of a starch in the coating composition can vary and will depend on the amount of nanoparticles which are to be applied to the paper, and on the rheological requirements of the application process. In addition, the available capacity during the subsequent drying of the packaging paper can play a role in the selection of the coating composition.

The coating composition contains between 10% by weight and 40% by weight nanoparticles of a starch, preferably between 20% by weight and 35% by weight, each with respect to the weight of the coating composition.

The statements provided above apply to the requirements for the nanoparticles of a starch, their size and their production process.

The coating composition can contain further components. This includes, for example, the aforementioned components of the packaging paper, such as filler materials, pigments, colorants and sizing agents, but also cross-linking agents.

In a preferred embodiment of the invention, the coating composition can contain talcum or kaolin or a mixture thereof, wherein the total amount of talcum and kaolin is between 30% by weight and 65% by weight with respect to the weight of the nanoparticles. These filler materials can increase the resistance against greases and oils due to the shape of their particles.

The production of the coating composition is preferably carried out in accordance with the requirements of the manufacture of the nanoparticles of a starch.

After application of the coating composition the packaging paper is preferably dried. Processes known in the prior art can be used for drying; examples are infra-red radiation, hot air or contact with a heated drying cylinder, microwaves or combinations thereof.

Further processing steps, such as printing, slitting, embossing or folding can be carried out as a function of the requirements of the end use of the packaging paper.

The following embodiments are intended to demonstrate the advantages of the packaging paper according to the invention.

BRIEF DESCRIPTION OF THE FIGURES

FIG. 1 shows a table 1, in which properties of packaging papers according to the invention and comparative examples not according to the invention are summarized.

FIG. 2 shows a table 2, in which further properties of the packaging papers of FIG. 1 are summarized.

DESCRIPTION OF THE SOME EMBODIMENTS, IN ACCORDANCE WITH AND NOT IN ACCORDANCE WITH THE INVENTION

Several papers were produced from mixtures of long-fiber and short-fiber pulp (Table 1, columns "Long Fiber" and "Short Fiber" and various filler materials (Table 1, column "Filler") which are designated in Tables 1 and 2 of FIG. 1 or 2, respectively, by A-L, wherein in Tables 1 and 2 the same letters in the column "Paper" indicate the same paper. The papers A, K and L are papers not according to the invention, which serve as comparative examples, while the papers B-J are packaging papers according to the invention.

The percentages regarding long-fiber pulp and short-fiber pulp are with respect to the weight of the fiber composition; the percentages regarding the filler materials are with respect to the basis weight of the packaging paper.

The papers were each sized in bulk with alkyl ketene dimer (AKD) according to the requirements on the $Cobb_{60}$ value. An aqueous composition with 33% by weight nanoparticles of a corn starch was applied to the felt side of papers B-E, G, H, K and L in the film press of the paper machine. For paper A, no composition was applied, for paper F, it was applied to both sides and for paper J, to the wire side. The amount of nanoparticles of a starch is given in Table 1, column "Nanoparticles". Table 1, column "Coating" indicates which side or which sides of the paper are coated; therein, "FS" designates the felt side and "WS" the wire side.

For all papers coated on one side, that is, B-E and G-L, ordinary starch was additionally applied to the uncoated side in a small amount of 0.1 g/m$^2$ to 0.5 g/m$^2$ to prevent curling of the packaging paper. After application of the coating composition, the papers were dried, conditioned in accordance with ISO 187 at 23° C. and 50% relative humidity and then measurements were carried out.

The basis weight of each packaging paper was measured in accordance with ISO 536:2012 and is given in Table 1, column "Basis Weight". The basis weights are between 25.4 g/m$^2$ and 46.3 g/m$^2$.

The Cobb$_{60}$ values, Table 2, column "Cobb$_{60}$" of the wire side ("WS") and the felt side ("FS") were measured in accordance with ISO 535:2014 for the papers B-L and with the basis weight from Table 1 the quotient of the Cobb$_{60}$ value and the basis weight was calculated for each side of the paper. It is given in Table 2, column "Relative Water Absorption".

The air permeability according to Gurley was determined in accordance with ISO 5636-5:2013, where the air was always flowing from the felt side to the wire side. The measurement results are given in Table 2, column "Air Permeability (Gurley)".

The resistance against greases and oils was measured several times in accordance with TAPPI T559 cm-12 for the coated side or the coated sides for each of the papers B-L. The result is given in Table 2, column "KIT level". For comparison, a measurement was carried out on both sides of the uncoated paper A.

Furthermore, the tensile strength and the elongation at break were determined in the machine direction and in the cross direction in accordance with ISO 1924-2:2008. The results are not given individually, but for the tensile strength in the machine direction they were always between 1.3 kN/m and 4.6 kN/m, while in the cross direction, they were between 0.9 kN/m and 2.4 kN/m. This tensile strength in any case is sufficient for trouble-free further processing.

The elongation at break in the machine direction was between 1.3% and 2.6% and in the cross direction between 2.9% and 5.8%. These values are also sufficient for trouble-free further processing.

From the uncoated paper A not according to the invention with a KIT level between 0 and 2 on each side, it can be seen that a coating of the paper with the nanoparticles of a starch is indeed necessary in order to obtain considerable resistance against greases and oils.

The papers according to the invention for the embodiments B to E show, for different basis weights from 25.4 g/m$^2$ to 45.9 g/m$^2$, that with a relative water absorption from 0.44 to 0.63 and an amount of nanoparticles of a starch from 1.7 g/m$^2$ to 5.1 g/m$^2$, a sufficient resistance against oils and greases, expressed by the KIT level, of 6-8 can be obtained.

The paper according to the invention of embodiment F exhibits a very high-quality packaging paper with a basis weight of 46.3 g/m$^2$ and titanium dioxide in the mixture of filler materials. In this manner, the paper produces a high opacity and whiteness. Paper F is coated on both sides with nanoparticles of a starch and thus has a very high resistance against oils and greases, expressed by the KIT level, of 9 to 11.

A comparison of the papers D and G according to the invention shows that both papers are very similar having regard to their basis weight, with 38.8 g/m$^2$ and 38.5 g/m$^2$. They do not differ in other essential parameters except for the air permeability, which for paper D is 6685 s according to Gurley and for paper G is 8320 s according to Gurley. Thus, paper D has higher air permeability and a resistance against oils and greases, expressed by the KIT level, of 6-7, while paper G achieves a KIT level of 7-8. This shows that a low air permeability and thus a high value in seconds according to Gurley can be of advantage for the resistance against oils and greases independently of other properties.

The paper of embodiment H according to the invention tests the limits of the invention and shows, for a high relative water absorption of 0.62 (FS) and 0.67 (WS) and a high air permeability of 1224 s according to Gurley, a resistance against greases and oils, expressed by the KIT level, of only 5-6. Therefore, this packaging paper is still sufficiently suitable for applications as a packaging paper for food.

The paper according to the invention of embodiment J demonstrates the invention for an alternative fiber mixture, consisting of 70% by weight long-fiber pulp and 30% by weight short-fiber pulp, each with respect to the mass of the fiber mixture, as well as a low filler content of 5% by weight with respect to the mass of the packaging paper. In addition, in contrast to all other embodiments, the coating is applied to the wire side. Despite all these modifications, the packaging paper produces a resistance against greases and oils of 6-7, expressed as the KIT level. In combination with the other embodiments, this shows that the relative water absorption and the air permeability separately, but also in combination, are particularly important in obtaining a high resistance against oils and greases.

Papers K and L, which are not according to the invention, are constituted by a paper (K) with a very small amount of size, with a relative water absorption of 0.82 to 0.90, which is too high to carry out the invention, and a paper (L) with a very large amount of size, with a relative water absorption of 0.20 to 0.25, which is too low to carry out the invention. Both papers produce a KIT level of at most 5, despite the application of well over 4 g/m$^2$ of the nanoparticles. In addition, these two exemplary embodiments not according to the invention demonstrate the particular importance of the relative water absorption for the resistance against greases and oils.

The invention claimed is:

1. Packaging paper for food, with a basis weight from 20 g/m$^2$ to 50 g/m$^2$, comprising cellulose fibers and one or more filler materials, wherein the total amount of filler materials is between 5% by weight and 20% by weight with respect to the weight of the packaging paper, wherein the packaging paper comprises a sizing agent that is contained in such an amount that a relative water absorption of 0.4 to 0.7 is obtained on both sides, wherein the relative water absorption is defined as the quotient of the Cobb$_{60}$ value, determined in accordance with ISO 535:2014, and the basis weight, has a coating on at least one side that comprises nanoparticles of a starch, wherein the coating contains between 1 g/m$^2$ and 6 g/m$^2$ of said nanoparticles, does not contain any compounds with the structure $CF_3(CF_2)_n(CH_2)_mX$, wherein n=5 or n=7 and m=0, 1 or 2 and X is a hydroxyl group (X=OH) or a carboxyl group (X=COOH), or the proportion of such compounds in the total mass of the packaging paper is less than 0.1‰, and has a resistance against greases and oils of 6 to 12, described by the KIT level in accordance with TAPPI T559 cm-12, wherein in the test in accordance with TAPPI T559 cm-12, the at least one side coated with said nanoparticles is exposed to the test liquids.

2. Packaging paper according to claim 1, with a basis weight of between 25 g/m$^2$ and 40 g/m$^2$.

3. Packaging paper according to claim 1, wherein the pulp is bleached, or wherein the pulp is unbleached.

4. Packaging paper according to claim 1, wherein said pulp fibers are at least to 95% by weight with respect to the pulp mass, formed by fresh fibers.

5. Packaging paper according to claim 1, wherein the total amount of filler materials is between 5% by weight and 15% by weight with respect to the weight of the packaging paper.

6. Packaging paper according to claim 1, wherein the one or more filler materials are selected from the group consisting of precipitated or geologically sourced calcium carbonate, magnesium carbonate, titanium dioxide, magnesium oxide, magnesium hydroxide, aluminum hydroxide, kaolin or talc.

7. Packaging paper according to claim 1, wherein the filler materials comprise a combination of titanium dioxide and an extender which, in combination with titanium dioxide, enhances its effect, wherein the extender is formed by calcinated kaolin, aluminum hydroxide ($Al(OH)_3$), a precipitated, amorphous silicate or a combination thereof.

8. Packaging paper according to claim 1, wherein the amount of nanoparticles of a starch in the packaging paper is between 1.5 g/m$^2$ and 5 g/m$^2$.

9. Packaging paper according to claim 1, wherein the nanoparticles are sourced from one or more of the following starches: potato starch, corn starch, wheat starch, rice starch or tapioca starch.

10. Packaging paper according to claim 1, wherein the sizing agent is formed by an alkyl ketene dimer (AKD), an alkenyl succinic anhydride (ASA) or a resin size.

11. Packaging paper according to claim 1, which is coated with the nanoparticles of a starch on only one side, and which is printed on the other side.

12. Packaging paper according to claim 1, wherein the relative water absorption of both sides is between 0.4 and 0.6.

13. Packaging paper according to claim 1, which has a resistance against greases and oils of 6 to 10, described by the KIT level in accordance with TAPPI T559 cm-12, wherein in the test in accordance with TAPPI T559 cm-12, the at least one side coated with said nanoparticles is exposed to the test liquids.

14. Packaging paper according to claim 1, with an air permeability according to Gurley of between 1000 s and 10000 s.

15. Packaging paper according to claim 1, with a thickness of between 20 μm and 60 μm.

16. Packaging paper according to claim 1 with a tensile strength in the machine direction of between 1 kN/m and 5 kN/m, and/or with a tensile strength in the cross direction of between 0.5 kN/m and 4 kN/m.

17. Packaging paper according to claim 1 with an elongation at break in the machine direction of between 1% and 3% and in the cross direction of between 2% and 6%.

18. Packaging paper according to claim 1, wherein the pulp fibers are sulfate pulp fibers and comprise 25% by weight to 75% by weight long fibers and 25% by weight to 75% by weight short fibers, with respect to the mass of the pulp fibers.

19. Packaging paper according to claim 18, wherein the long fiber pulp is sourced from one or more of the plants spruce, pine, flax, hemp, sisal, abacá, ramie, jute and kenaf and/or the short fiber pulp is sourced from one or more of the tree species birch, beech and/or *eucalyptus*.

20. Packaging paper according to claim 1, wherein the mean size of the nanoparticles is between 1 nm and 500 nm.

21. Packaging paper according to claim 20, wherein the mean size of the nanoparticles is between 40 nm and 200 nm.

22. Packaging paper according to claim 1, which further contains one or more of the following components:

a wet strength agent, which is suitable for increasing the strength of the packaging paper in the wet state, starch, which is not present in the form of nanoparticles, wherein, in the case in which the packaging paper is coated with the nanoparticles of a starch on only one side, the starch is applied to the other side of the packaging paper, pigments or colorants, or gold foil.

23. Packaging paper according to claim 22, wherein the pigments or colorants are yellow, red, brown or black iron oxides or carbon particles.

24. Process for the manufacture of a packaging paper according to claim 1, wherein the nanoparticles of a starch are applied as component of a coating composition during manufacture of the packaging paper in a paper machine, or in an application device separated from the paper machine to form a preliminary paper, wherein the coating composition contains at least water and said nanoparticles, and wherein the coating composition contains between 10% by weight and 40% by weight of said nanoparticles, each with respect to the weight of coating composition.

25. Process according to claim 24, wherein the coating composition further contains talcum and/or kaolin, of which the total mass corresponds to 30% to 65% by weight of the mass of said nanoparticles.

26. Process according to claim 24, wherein the coating composition is applied to one side of the packaging paper in the form of a pattern, and wherein on the other side, the coating composition is applied in an at least approximately complementary pattern, so that every region of the packaging paper is coated with the nanoparticles of a starch on at least one side of the packaging paper.

27. Process according to claim 24, wherein the nanoparticles of a starch are applied as a component of a coating composition during manufacture of the packaging paper in a film press or size press of said paper machine.

* * * * *